US008944037B2

(12) United States Patent
Yonekawa et al.

(10) Patent No.: US 8,944,037 B2
(45) Date of Patent: Feb. 3, 2015

(54) EXHAUST GAS PURIFYING APPARATUS FOR INTERNAL COMBUSTION ENGINE

(75) Inventors: Yutaka Yonekawa, Kariya (JP); Tomoaki Nakano, Toyota (JP)

(73) Assignee: Denso Corporation, Kariya (JP)

( * ) Notice: Subject to any disclaimer, the term of this patent is extended or adjusted under 35 U.S.C. 154(b) by 993 days.

(21) Appl. No.: 12/751,241

(22) Filed: Mar. 31, 2010

(65) Prior Publication Data

US 2010/0242934 A1 Sep. 30, 2010

(30) Foreign Application Priority Data

Mar. 31, 2009 (JP) ..... 2009-86480

(51) Int. Cl.

| | |
|---|---|
| ***F02D 41/00*** | (2006.01) |
| ***F01N 3/00*** | (2006.01) |
| ***F02D 41/14*** | (2006.01) |
| ***F02D 41/02*** | (2006.01) |
| *F01N 3/08* | (2006.01) |
| *F01N 3/20* | (2006.01) |

(52) U.S. Cl.

CPC ..... *F02D 41/1441* (2013.01); *F02D 41/0295* (2013.01); *F02D 41/1475* (2013.01); *F01N 3/0871* (2013.01); *F01N 3/20* (2013.01); *F02D 2200/0814* (2013.01)

USPC ..... 123/672; 60/285; 60/299

(58) Field of Classification Search

USPC ..... 123/672, 698, 699; 60/285, 299, 777; 701/103

See application file for complete search history.

(56) References Cited

U.S. PATENT DOCUMENTS

| | | | | |
|---|---|---|---|---|
| 4,653,449 | A * | 3/1987 | Kamei et al. | 123/478 |
| 4,745,741 | A * | 5/1988 | Masui et al. | 60/274 |
| 5,569,847 | A * | 10/1996 | Hasegawa et al. | 73/114.72 |
| 5,887,421 | A * | 3/1999 | Mitsutani | 60/274 |
| 6,161,376 | A | 12/2000 | Uchikawa | |
| 6,672,051 | B2 * | 1/2004 | Tamura et al. | 60/285 |
| 7,454,900 | B2 * | 11/2008 | Hayashi | 60/295 |
| 8,141,344 | B2 * | 3/2012 | Miyashita | 60/285 |
| 8,209,954 | B2 * | 7/2012 | Yoshida et al. | 60/285 |
| 8,266,893 | B2 * | 9/2012 | Matsuno et al. | 60/286 |

(Continued)

FOREIGN PATENT DOCUMENTS

| | | |
|---|---|---|
| JP | 2003-49681 | 2/2003 |
| JP | 2004-137908 | 5/2004 |

(Continued)

OTHER PUBLICATIONS

Japanese Office Action dated Jun. 21, 2011, issued in corresponding Japanese Application No. 2009-086480 with English Translation.

*Primary Examiner* — Mahmoud Gimie
*Assistant Examiner* — David Hamaoui
(74) *Attorney, Agent, or Firm* — Nixon & Vanderhye P.C.

(57) ABSTRACT

An exhaust gas purifying apparatus for an internal combustion engine includes a lean control unit and a rich control unit. The lean control unit executes lean spike operation, in which an air-fuel ratio is temporarily changed in a lean direction by a lean change width relative to a reference air-fuel ratio. The rich control unit changes the air-fuel ratio in a rich direction by a rich change width relative to the reference air-fuel ratio after the lean control unit executes the lean spike operation such that the air-fuel ratio stays in a predetermined slightly rich region. The rich change width is smaller than the lean change width.

5 Claims, 11 Drawing Sheets

(56) References Cited

U.S. PATENT DOCUMENTS

| | | | | |
|---|---|---|---|---|
| 8,336,294 | B2 * | 12/2012 | Fukuda et al. | 60/285 |
| 2001/0045091 | A1 | 11/2001 | Tamura et al. | |

FOREIGN PATENT DOCUMENTS

| | | |
|---|---|---|
| JP | 2005-248884 | 9/2005 |
| JP | 2006-214342 | 8/2006 |

* cited by examiner

EXHAUST GAS PURIFYING APPARATUS FOR INTERNAL COMBUSTION ENGINE

CROSS REFERENCE TO RELATED APPLICATION

This application is based on and incorporates herein by reference Japanese Patent Application No. 2009-86480 filed on Mar. 31, 2009.

BACKGROUND OF THE INVENTION

1. Field of the Invention

The present invention relates to an exhaust gas purifying apparatus for an internal combustion engine.

2. Description of Related Art

Conventionally, a three-way catalytic converter has been known to purify HC, CO, and NOx in exhaust gas of an internal combustion engine. The three-way catalytic converter mainly includes a precious metal, an element, and a oxygen storage medium. The precious metal serves as a catalyst composition, and the element, such as alumina, is used to disperse the precious metal. The oxygen storage medium stores and releases oxygen in exhaust gas.

The three-way catalytic converter functions as an oxygen storage that stores oxygen in exhaust gas by using the oxygen storage medium, and the oxygen storage function is used to improve the exhaust gas purification efficiency. In other words, when the air-fuel ratio of exhaust gas is lean relative to a target air-fuel ratio (or a theoretical air-fuel ratio, for example), the oxygen storage medium of the catalytic converter stores $O_2$. When the air-fuel ratio is rich, $O_2$ stored in the oxygen storage medium is released to exhaust gas in order to oxidize HC and CO.

In an internal combustion engine provided with the three-way catalytic converter, the air-fuel ratio of exhaust gas is periodically switched between rich and lean relative to the target air-fuel ratio at predetermined intervals in order to effectively purify exhaust gas through the above oxygen storage function. Thus, the storage and release of $O_2$ is repeated in the oxygen storage medium of the catalytic converter, and thereby exhaust gas purification performance of the catalytic converter is improved (for example, see JP-A-2005-248884).

Typically, the precious metal serving as the catalyst composition for the three-way catalytic converter includes rhodium (Rh), palladium (Pd), and platinum (Pt). Rh provides the highest NOx purification efficiency. Oxide of Rh is amphoteric oxide, and in contrast, Pd and Pt are basic oxide. Thus, Rh facilitates steam reforming reaction ($C_mH_n + mH_2O \rightarrow (m+n/2)H_2 + mCO$) as compared to the other precious metals, and thereby formation of $H_2$, which is reductant, is facilitated. However, Rh is more expensive as compared to Pt, and thereby there is needed that the precious metal (Pt and Pd) other than Rh is used for the catalyst composition of the three-way catalytic converter. In other words, it is required to develop a catalytic converter without Rh (for example, having Pt instead), which converter still has exhaust gas purification performance equivalent to performance of a catalytic converter having Rh.

SUMMARY OF THE INVENTION

The present invention is made in view of the above disadvantages. Thus, it is an objective of the present invention to address at least one of the above disadvantages.

To achieve the objective of the present invention, there is provided an exhaust gas purifying apparatus for an internal combustion engine, wherein an exhaust passage of the internal combustion engine is provided with a catalytic converter that includes an oxygen storage medium and a precious metal, wherein the oxygen storage medium stores and releases oxygen in exhaust gas, wherein the precious metal serves as a catalyst composition, the exhaust gas purifying apparatus including lean control means and rich control means. The lean control means executes lean spike operation, in which an air-fuel ratio is temporarily changed in a lean direction by a lean change width relative to a reference air-fuel ratio. The rich control means changes the air-fuel ratio in a rich direction by a rich change width relative to the reference air-fuel ratio after the lean control means executes the lean spike operation such that the air-fuel ratio stays in a predetermined slightly rich region. The rich change width is smaller than the lean change width.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF PREFERRED EMBODIMENTS (First Embodiment)

Figure 1:
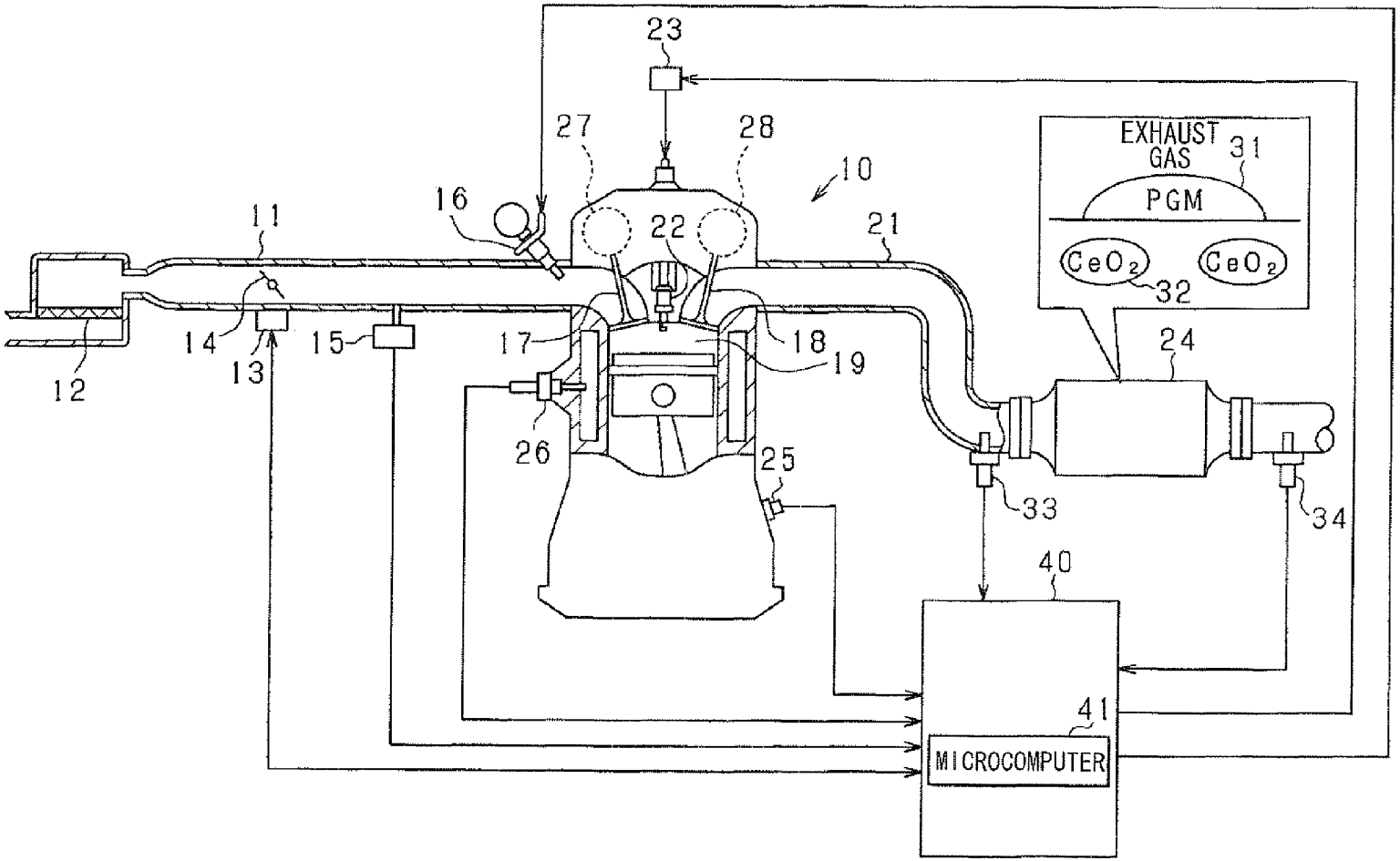
FIG. 1 is a diagram illustrating an entire schematic structure of an engine control system of the first embodiment of the present invention.

The first embodiment of the present invention will be described below with reference to the accompanying drawings. The present embodiment constitutes an engine control system for a gasoline engine for a vehicle. The control system mainly has an electronic control unit (hereinafter, referred as ECU) that controls a fuel injection quantity and controls ignition timing. FIG. 1 is a diagram illustrating an entire schematic structure of the engine control system.

In FIG. 1, an engine 10 is provided with an intake pipe 11 (intake passage), and an air cleaner 12 is provided at an upstream end of the intake pipe 11. A throttle valve 14 is provided downstream of the air cleaner 12, and an opening of the throttle valve 14 is adjusted by a throttle actuator 13, such as a DC motor. The opening of the throttle valve 14 (throttle opening) is detected by a throttle opening sensor included in the throttle actuator 13. Also, an intake pipe pressure sensor 15 is provided downstream of the throttle valve 14 for detecting pressure in the intake pipe. A fuel injection valve 16 is provided downstream of the intake pipe pressure sensor 15 in a vicinity of the intake port. The fuel injection valve 16 is electromagnetically actuated to inject fuel.

An intake port and an exhaust port of the engine 10 are provided with an intake valve 17 and an exhaust valve 18, respectively. When the intake valve 17 is opened, air-fuel mixture is introduced into a combustion chamber 19. When the exhaust valve 18 is opened, exhaust gas after combustion is discharged to an exhaust pipe 21 (exhaust passage). Also, the intake valve 17 and the exhaust valve 18 are provided with variable valve timing apparatuses 27, 28, respectively, for changing timing of opening and closing the corresponding valves 17, 18.

An ignition plug 22 is provided to a cylinder head of the engine 10. The ignition plug 22 is applied with high voltage at desired ignition timing through an ignition device 23 having an ignition coil. The application of high voltage generates spark discharge between opposed electrodes of the ignition plug 22, and air-fuel mixture introduced into the combustion chamber 19 is ignited for combustion.

Also, the exhaust pipe 21 is provided with a three-way catalytic converter 24 that purifies three components of exhaust gas, such as CO, HC, and NOx. The three-way catalytic converter 24 includes a ceramic or metal supporter and a coat layer formed on a surface of the supporter. Typically, the supporter has a honeycomb structure. The coat layer includes an element, a precious metal 31, and a co-catalyst 32. The element includes alumina, and the precious metal 31 serves as a catalyst composition. The co-catalyst 32 serves as an oxygen storage medium. The surface of the element of the coat layer is used to disperse the precious metal 31. The precious metal 31 is categorized in platinum-group metals (PGM), and in the present embodiment, the precious metal 31 employs platinum (Pt), which becomes basic oxide when oxidized. It should be noted that Rh, which becomes amphoteric oxide when oxidized, is not included as a metal in the catalytic converter 24. Also, the co-catalyst 32 stores and releases oxygen in exhaust gas. In the present embodiment, the co-catalyst 32 includes cerium oxide ($CeO_2$, $Ce_2O_3$).

The three-way catalytic converter 24 stores oxygen when the air-fuel ratio goes lean. When the air-fuel ratio goes rich subsequently, the three-way catalytic converter 24 releases stored oxygen. The above function of the three-way catalytic converter 24 is referred as $O_2$ storage function. The $O_2$ storage function is achieved by the co-catalyst 32 of the catalytic converter 24, and the $O_2$ storage function limits the fluctuation of the air-fuel ratio of the exhaust gas in the vicinity of the catalytic converter 24 such that the catalytic performance of the catalytic converter 24 is maintained high. Specifically, when the air-fuel ratio goes lean, cerium oxide in the form of $Ce_2O_3$ stores $O_2$ such that cerium oxide ($Ce_2O_3$) changes into $CeO_2$. When the air-fuel ratio goes rich, the co-catalyst 32 releases $O_2$ such that HC and CO in exhaust gas are oxidized to form $CO_2$ and $H_2O$.

In order to effectively enhance performance for purifying exhaust gas achieved by the three-way catalytic converter 24, it is necessary to perform combustion at a predetermined air-fuel ratio range (window) around a theoretical air-fuel ratio. It should be noted that a center of the range (window) corresponds to a slightly rich air-fuel ratio.

An A/F sensor 33 is provided upstream of the three-way catalytic converter 24, and detects an air-fuel ratio (oxygen concentration) of air-fuel mixture based on exhaust gas. When voltage is applied to a sensor element of the A/F sensor 33, the A/F sensor 33 outputs air-fuel ratio signals in a wide range in proportional to an oxygen concentration in exhaust gas. Also, an $O_2$ sensor 34 is provided downstream of the three-way catalytic converter 24, and detects an air-fuel ratio (oxygen concentration) of exhaust gas. The $O_2$ sensor 34 has a pair of electrodes, and electromotive force is generated between the electrodes based on the difference of the oxygen concentrations between atmosphere and exhaust gas.

Figure 2:
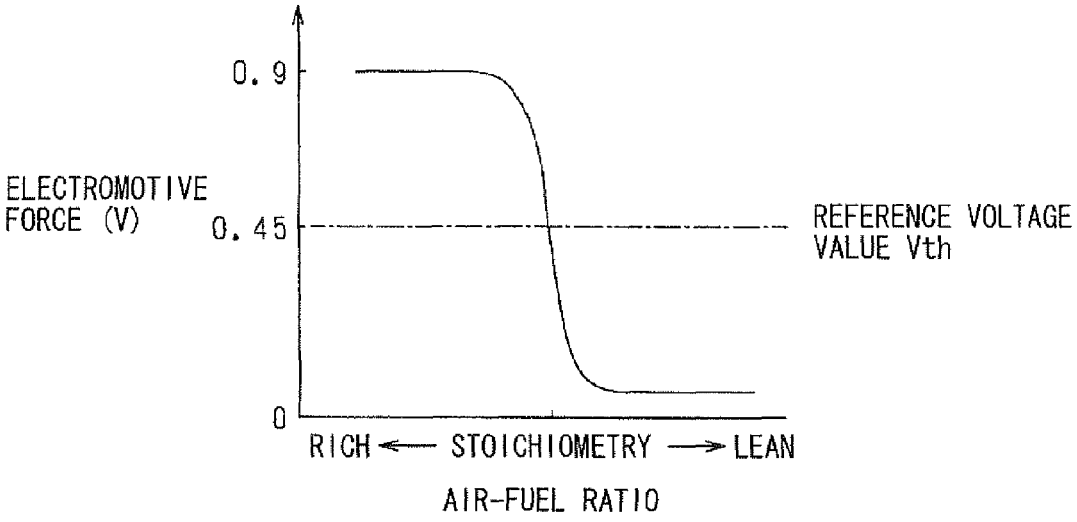
FIG. 2 is a characteristic diagram of electromotive force of an $O_2$ sensor.

FIG. 2 is a electromotive force characteristic diagram illustrating a relation between the air-fuel ratio and the electromotive force of the $O_2$ sensor 34. As shown in FIG. 2, the $O_2$ sensor 34 generates different electromotive force when the air-fuel ratio is rich or lean. The electromotive force sharply changes around a theoretical air-fuel ratio (stoichiometry). Thus, it is detected whether the air-fuel ratio is rich or lean by comparing the detected value of the electromotive force and a reference voltage value Vth (for example, the theoretical air-fuel ratio value of 0.45 V) that is preset in the middle of the variation (e.g., amplitude) of the electromotive force, Specifically, the electromotive force value $VO_2$, which corresponds to the output value of the $O_2$ sensor 34, is greater than the reference voltage value Vth, it is determined that the air-fuel ratio is rich. In contrast, when the electromotive force value $VO_2$ is equal to or less than the reference voltage value Vth, it is determined that the air-fuel ratio is lean.

In the present system, there are provided with a crank angle sensor 25 and a coolant temperature sensor 26. The crank angle sensor 25 outputs a crank angle signal at every predetermined crank angle of rotation of the engine 10, and the coolant temperature sensor 26 detects temperature of coolant for the engine 10.

An ECU 40 is mainly made of a known microcomputer 41 that includes a CPU, a ROM, and a RAM, for example. The ECU 40 executes various control programs stored in the ROM to control the engine 10 in accordance with the engine operational state. Specifically, the microcomputer 41 of the ECU 40 receives various detection signals from the above various sensors, and computes a fuel injection quantity and ignition timing based on the various detection signals in order to control the fuel injection valve 16 and the ignition device 23.

As fuel injection quantity control, the microcomputer 41 of the ECU 40 uses the electric current value of the A/F sensor 33 and the electromotive force value of the $O_2$ sensor 34 in order to execute air-fuel ratio control such that an actual air-fuel ratio becomes a target air-fuel ratio (for example, the theoretical air-fuel ratio). As the air-fuel ratio control, the microcomputer 41 executes stoichiometry combustion control, in which the microcomputer 41 basically feed-back controls the air-fuel ratio such that the air-fuel ratio stays within a region around the stoichiometry such that the three-way catalytic converter 24 is capable of achieving sufficient performance for purifying exhaust gas.

The inventors identified that when Pt or Pd is employed as the precious metal 31 of the three-way catalytic converter 24, NOx purification efficiency degrades compared with comparison a case, where Rh is employed as the precious metal 31. It is assumed that in the comparison case, steam reforming reaction tends to be more facilitated because the oxide of Rh is amphoteric oxide. In contrast, when Pt or Pd is employed, the steam reforming reaction tends to be less facilitated because the oxide of Pt or Pd is basic oxide. In other words, it is known that the steam reforming reaction is facilitated by weak basic metal, and generation or formation of $H_2$ is facilitated with the promotion of the steam reforming reaction. Also, because $H_2$ has strong reduction power, reduction of NOx is executed appropriately. As a result, when Rh is employed as the precious metal 31 as in the comparison case, the steam reforming reaction is facilitated because of the acid of the oxide of Rh, and also the formed $H_2$ serves as a reductant to purify NOx in exhaust gas. In contrast, when Pt or Pd is employed as the precious metal 31, the above reaction is not facilitated. As a result, when Rh is employed as the precious metal 31, the higher NOx purification efficiency is achievable compared with the case, where Pt or Pd is employed as the precious metal 31.

However, because Rh is more expensive than Pt or Pd in general, there is needed to achieve a NOx purification efficiency by Pt or Pd, which efficiency is equivalent to a NOx purification efficiency achievable by Rh. Thus, the inventors studied a method or procedure to improve the NOx purification efficiency achieved by the three-way catalytic converter 24 using Pt or Pd. As a result, the inventors identified that generation of $H_2$ is effectively facilitated by a water-gas shift reaction.

Specifically, a condition for facilitating the water-gas shift reaction is actively established through the air-fuel ratio control such that generation of $H_2$ from CO or $H_2O$ in exhaust gas is more facilitated in the three-way catalytic converter 24.

In the three-way catalytic converter 24 that has the precious metal 31 (for example, Pt, Pd) and the oxygen storage medium 32 (for example, ceria ($CeO_2$)), water-gas shift reaction occurs as described by equation 1 below, Hydrogen gas ($H_2$), which is a product of the reaction of equation 1, serves as a reductant used for NOx purification.

$$CO+H_2O \rightarrow CO_2+H_2 \quad \text{(equation 1)}$$

Also, the water-gas shift reaction in the three-way catalytic converter 24 shown in equation 1 is executed based on each reaction shown in equation 2 to equation 4 when platinum is employed as the precious metal.

$$Pt+CO \rightarrow Pt^*—CO \quad \text{(equation 2)}$$

$$Pt^*—CO+2CeO_2 \rightarrow Ce_2O_3+Pt^*+CO_2 \quad \text{(equation 3)}$$

$$Ce_2O_3+H_2O \rightarrow 2CeO_2+H_2 \quad \text{(equation 4)}$$

It is assumed that it is possible to effectively purify NOx in exhaust gas by increasing the generation amount of $H_2$ because $H_2$ has a strong reduction power.

The air-fuel ratio control for generating $H_2$ through the water-gas shift reaction will be describe below. The water-gas shift reaction in the three-way catalytic converter 24 is expressed by equation 1, and more specifically by equation 2 to equation 4 as shown above. In order to facilitate each of the reactions of equation 2 to equation 4, and thereby to facilitate the generation of $H_2$, it is required to set up conditions to satisfy the following three requirements for the three-way catalytic converter 24.

requirement [1] Generation of $CeO_2$ requirement [2] Generation of Pt*—CO requirement [3] Formation of a coexistence state, in which Pt*—CO and $CeO_2$ coexist.

For example, in order to satisfy requirement [1], the three-way catalytic converter 24 is conditioned under $O_2$ atmosphere (or the air-fuel ratio is controlled to be lean). Also, in order to satisfy requirement [2], CO is supplied to the three-way catalytic converter 24 (or the air-fuel ratio is controlled to be rich). Further, in order to satisfy requirement [3], atmosphere is maintained under slightly fuel-rich atmosphere. More specifically, by the air-fuel ratio is changed in a rich direction relative to a theoretical air-fuel ratio by an air-fuel ratio change width that is greater than an air-fuel ratio change width, by which the air-fuel ratio is changed in the lean direction relative to the theoretical air-fuel ratio during the lean control. Thus, the inventors assumed that generation of $H_2$ is more facilitated through the water-gas shift reaction by the above operation.

Figure 3A:
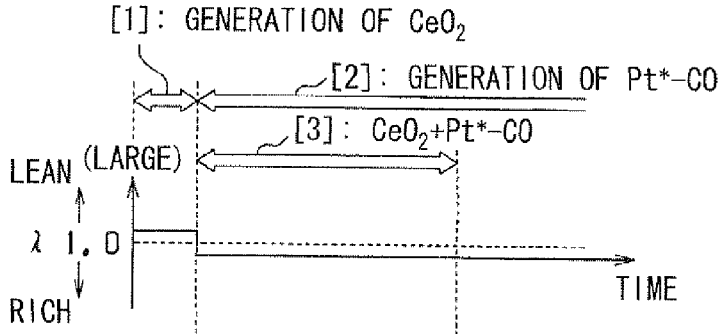
FIG. 3A is a timing chart illustrating a trend of an excess air factor during air-fuel ratio control.
Figure 3B:
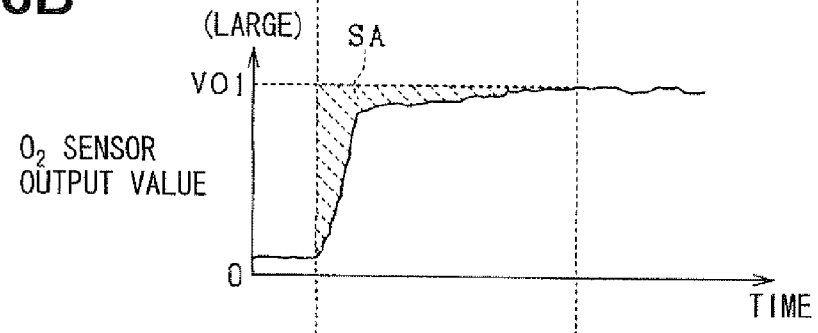
FIG. 3B is a timing chart illustrating a trend of an output of the $O_2$ sensor during the air-fuel ratio control.
Figure 3C:
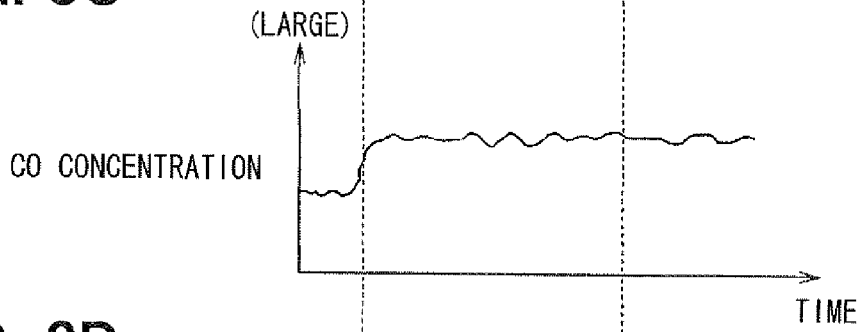
FIG. 3C is a timing chart illustrating a trend of CO concentration during the air-fuel ratio control.
Figure 3D:
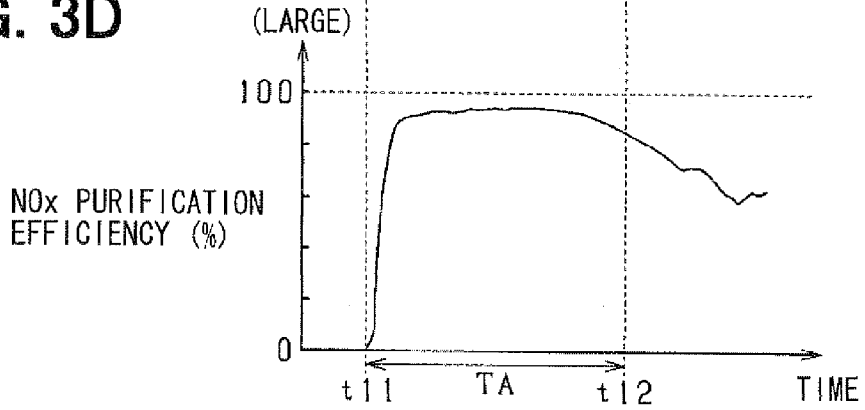
FIG. 3D is a timing chart illustrating a trend of NOx purification efficiency during the air-fuel ratio control.

The inventors have studied to improve the NOx purification efficiency by the facilitation of the water-gas shift reaction. FIGS. 3A to 3D are timing charts illustrating a trend of NOx purification efficiency with the air-fuel ratio control. More specifically, FIG. 3A shows a trend of an excess air factor λ, FIG. 3B shows a trend of the electromotive force value of the $O_2$ sensor, FIG. 3C shows a trend of the concentration of CO in exhaust gas upstream of the catalytic converter 24, and FIG. 3D shows a trend of the NOx purification efficiency. It should be noted that the NOx purification efficiency is computed by dividing a NOx reaction amount by a NOx amount upstream of the catalytic converter 24. The NOx reaction amount is a difference between (a) a NOx amount upstream of the catalytic converter 24 and (b) a NOx amount downstream of the catalytic converter 24. In other words, the following equation indicates the NOx purification efficiency.

NA=(Y1−Y2)/Y1, where:

NA indicates the NOx purification efficiency;

Y1 indicates the NOx amount measured at a position upstream of the catalytic converter 24; and Y2 indicates the NOx amount measured at a position downstream of the catalytic converter 24.

In FIG. 3A to FIG. 3D, firstly, the air-fuel ratio is controlled to be lean (lean control) in order to form $CeO_2$ in the catalytic converter 24. Subsequently, the air-fuel ratio is switched to be rich (rich control) at time t11 in order to form Pt*-CO. Due to the above, CO concentration in exhaust gas that is introduced into the catalytic converter 24 is increased (see FIG. 3C), and Pt*—CO is formed on the surface of the catalytic converter 24. Also, When the air-fuel ratio estimated based on exhaust gas goes rich, $O_2$ in the catalytic converter 24 is released, and thereby the electromotive force value of the $O_2$ sensor 34 is increases (see FIG. 33). At the above time, the electromotive force value of the $O_2$ sensor 34 does not sharply increase to a maximum value VO1 of the electromotive force value that is achievable under a fuel-rich atmosphere. However, the electromotive force value reaches the maximum value VO1 at time t12 after a predetermined time has elapsed since time t11. The above happens because when the catalytic converter 24 is exposed in the fuel-rich atmosphere, the catalytic converter 24 releases the amount of $O_2$ that corresponds to a region SA in FIG. 3B. This means that the catalytic converter 24 still stores $O_2$ or that $CeO_2$ still exists in the catalytic converter 24. In other words, because Pt*—CO and $CeO_2$ coexist in a period TA measured between time t11 and time t12, $H_2$ is being generated through equation 3 and equation 4 in the period TA. Thereby, in the period TA, the NOx purification efficiency sharply increases to a value of generally 100%, and then the NOx purification efficiency is maintained at the value. Subsequently, the NOx purification efficiency decreases with the decrease of a degree, by which Pt*—CO and $CeO_2$ coexist.

Further, the inventors studied preferable example, in which the water-gas shift reaction is facilitated, for the lean control and the rich control. The conditions are detailed below.

(Lean Control)

Figure 4:
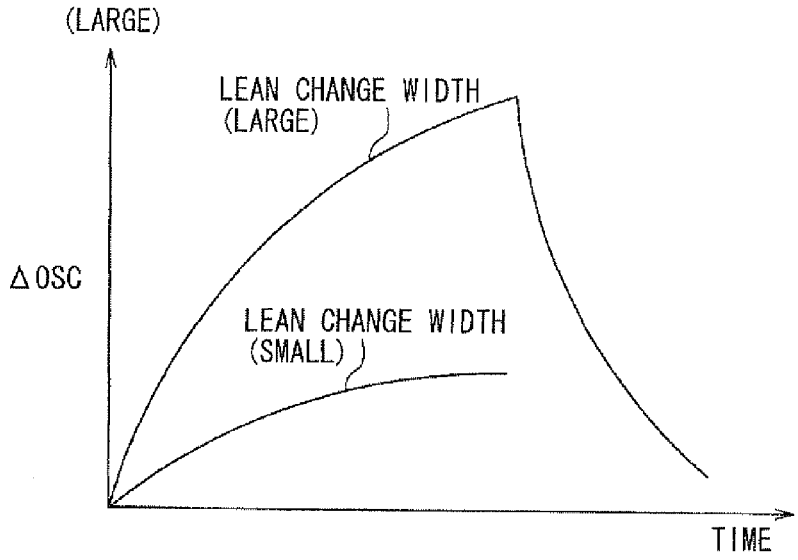
FIG. 4 is a diagram illustrating a relation between an increase amount ΔOSC of stored oxygen and a lean change width.

In general, an oxygen storage amount of the three-way catalytic converter 24 changes with the change of an amount of oxygen in exhaust gas. In other words, the amount of oxygen stored in the three-way catalytic converter 24 changes with the change of oxygen concentration in exhaust gas. The FIG. 4 shows an increase amount ΔOSC of the stored oxygen with respect to the amount of oxygen in exhaust gas. Specifically, when the oxygen concentration near the three-way catalytic converter 24 changes relatively widely, the increase amount ΔOSC of the stored oxygen is more increased. In other words, when a magnitude (lean change width) of change in the lean direction of the air-fuel ratio detected based on exhaust gas is greater, oxygen storage speed becomes greater. As a result, when the air-fuel ratio is controlled to go lean in order to achieve the requirement [1], the oxygen storage speed results in small if the lean change width is small. Thereby, $O_2$ in exhaust gas more tends to attach to the surface of the precious metal 31, and consequently, the performance of purification through the three-way catalyst may deteriorate as a result of the excessive attachment of the oxygen on the surface of the precious metal 31. In consideration of the above, when the air-fuel ratio is controlled to go lean, the lean change width is to be maximized and simultaneously a time period, during which the three-way catalytic converter 24 contacts $O_2$, is to be minimized. In other words; in the lean control of the present embodiment, the air-fuel ratio is controlled under lean spike operation, in which the air-fuel ratio is temporarily changed in the lean direction relative to the theoretical air-fuel ratio by the lean change width such that the air-fuel ratio is temporarily changed to go lean, for example.

(Rich Control)

When the air-fuel ratio is controlled to be rich in the rich control, the air-fuel ratio is made to stay in a predetermined range in a rich region around the theoretical air-fuel ratio. In other words, in the rich control, the air-fuel ratio is changed in a rich direction by a rich change width relative to the theoretical air-fuel ratio such that the air-fuel ratio stays in a predetermined slightly rich region near the theoretical air-fuel ratio, for example. The above operation is done because $O_2$ stored in the catalytic converter 24 tends to be released in exhaust gas when the air-fuel ratio in exhaust gas is excessively rich, and thereby the release of $O_2$ may otherwise shorten the time period of coexistence state of Pt*—CO and $CeO_2$ for requirement [3]. Also, by controlling the air-fuel ratio to be slightly rich, it is possible to maintain a state, where Pt*—CO is formed on the surface of the catalytic converter 24, for a longer time period. In view of the above, a slightly rich air-fuel ratio, which is appropriate for limiting the release of oxygen from the co-catalyst 32, is preset as a target air-fuel ratio, and the above target air-fuel ratio is used in the air-fuel ratio control in the rich control. In the present embodiment, for example, the slightly rich air-fuel ratio corresponds to an air-fuel ratio that is middle of the predetermined range (window) in the rich region.

A time period for the rich control is made longer than a time period for the lean control. Specifically, in the lean control, fuel-lean gas is introduced momentarily as the lean spike operation in order to limit the excessive oxygen attachment. In contrast, in the rich control, the duration for introducing fuel-rich gas is maintained relatively long in order to maximize the time period of coexistence of Pt*—CO and $CeO_2$. For example, the time period for the rich control is made several times to a dozen or so times of the time period for the lean control.

Figure 5:
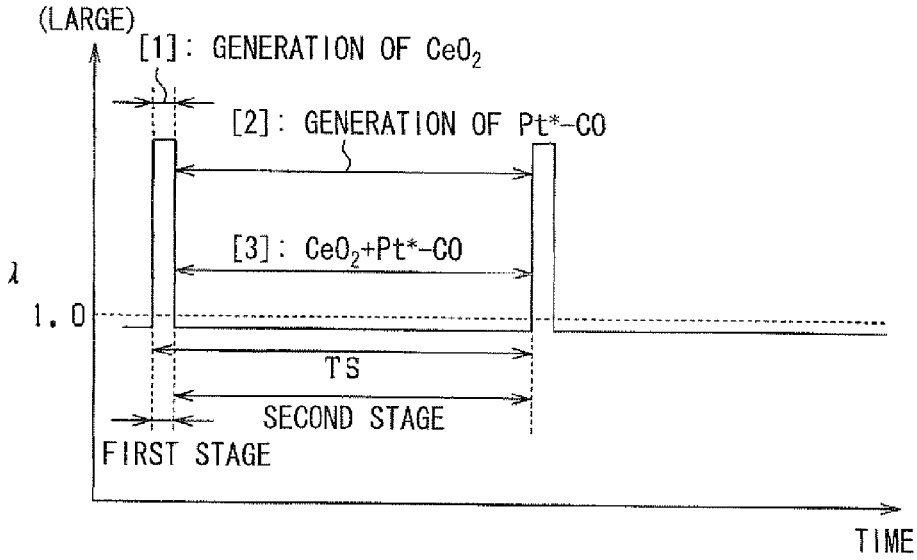
FIG. 5 is a timing chart illustrating an example of the air-fuel ratio control.

In view of the above study, the air-fuel ratio control in the present embodiment is executed such that the air-fuel ratio of exhaust gas is controlled at slightly rich, and that the lean spike operation is intermittently executed under the slightly fuel-rich atmosphere. Specifically, based on the output values of the A/F sensor 33 and the $O_2$ sensor 34, the air-fuel ratio of exhaust gas is controlled at the predetermined value within the slightly rich region. For example, the above predetermined value corresponds to the air-fuel ratio in the middle of the window. Then, the lean spike operation is executed under the above conditioned slightly fuel-rich atmosphere at predetermined intervals. Specifically, as shown in FIG. 5, a basic process, which is time period TS long and includes a first stage and a second stage, is repeatedly executed. Typically, in the first stage, the lean control is executed to cause the catalytic converter 24 to store oxygen, and the second stage follows the first stage. In the second stage, the rich control is executed in order to cause a specified component (CO) in exhaust gas to adsorb to the precious metal 31, and also in order to limit the release of oxygen from the catalytic converter 24. Thus, all of the above requirements [1] to [3] are satisfied, and thereby the generation of $H_2$ through the water-gas shift reaction is effectively facilitated.

Figure 6:
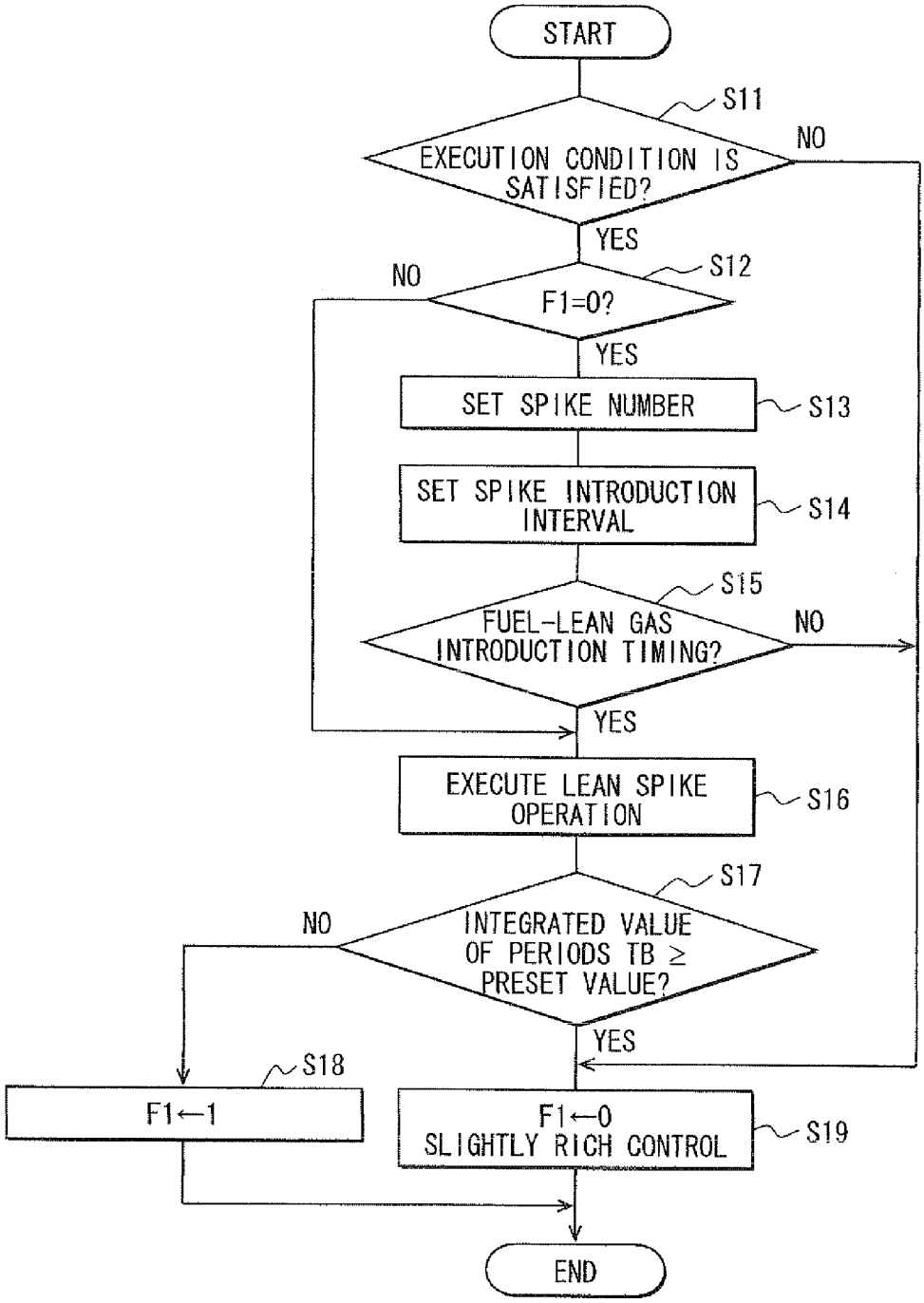
FIG. 6 is a flow chart illustrating procedure of the air-fuel ratio control for facilitating water-gas shift reaction.

FIG. 6 shows a flow chart illustrating a procedure for the air-fuel ratio control to facilitate the water-gas shift reaction. The above process is executed by the microcomputer 41 of the ECU 40 at predetermined intervals.

In FIG. 6, at step S11, it is determined whether predetermined execution condition is satisfied based on the engine operational state. The execution condition may be, for example, at least one of the three following conditions. The First Condition: The engine coolant temperature detected by the coolant temperature sensor 26 is equal to or greater than a predetermined temperature suitable for the determination of the catalytic activity of the catalytic converter. The Second Condition: In the determination of the lean burn/the rich burn based on the output value of the $O_2$ sensor 34, the determination of that the operational state is under the lean burn has not remained for a period equal to or greater than a predetermined time. In other words, a lean input time period, during which the output value indicative of the lean burn has been outputted by the $O_2$ sensor 34, is less than the predetermined time. The Third Condition: The fuel cut operation is not being executed or a predetermined time has elapsed after the fuel cut operation.

When the execution condition is determined to be satisfied, control proceeds to step S12, where it is determined whether a fuel-lean gas introduction flag F1 is value 0. The fuel-lean gas introduction flag F1 indicates that the present time is within the period for introducing fuel-lean gas. In other words, the fuel-lean gas introduction flag F1 indicates whether the introduction of the fuel-lean gas is currently required. Specifically, when the fuel-lean gas introduction flag F1 indicates value 1, the present time is within the introduction period (the first stage) for introducing the fuel-lean gas. Also, when the fuel-lean gas introduction flag F1 indicates value 0, the present time is not within the introduction period for the fuel-lean gas. When the fuel-lean gas introduction flag F1 is value 0, control proceeds to step S13, where an oxygen introduction amount in the first stage is set based on the engine operational state. In the present embodiment, the oxygen introduction amount is change by changing the number of times (hereinafter referred as the spike number) for executing multiple spike segments for the lean spike operation. Specifically, the lean change width for the lean spike operation is fixed at an allowable maximum value (allowable maximum change width A1) that is determined in view of drivability, and the spike number for executing the multiple spike segments in the lean spike operation is changed in accordance with the engine operational state. As above, the oxygen introduction amount in the first stage is modified.

Figure 7:
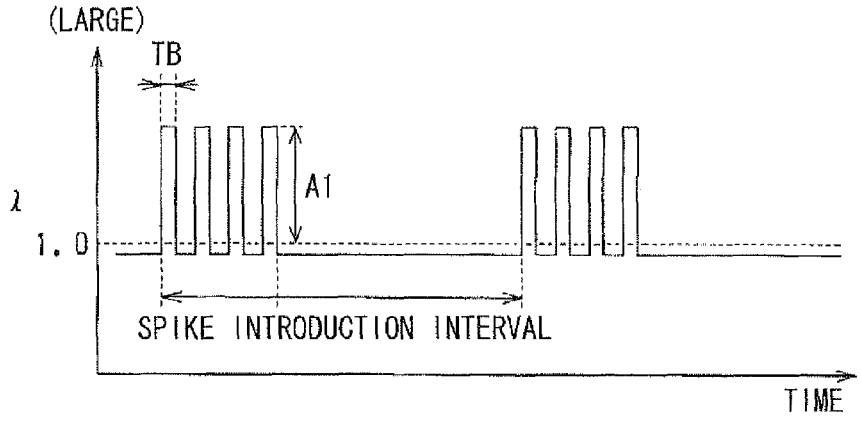
FIG. 7 is a timing chart illustrating an example of the lean spike operation.

The oxygen introduction amount is changed based on the spike number of executing the spike segments in the lean spike operation because of the following reasons. As shown in FIG. 4, when the air-fuel ratio is changed from rich to lean, the increase amount ΔOSC of oxygen stored in the catalytic converter 24 becomes greater with the increase of the magnitude of the lean change width. As a result, it is possible to effectively limit the excessive attachment of oxygen to the catalytic converter 24. Consequently, from a view point of limiting the excessive attachment of oxygen as above, for example, it may be better to execute a single spike segment in the lean spike operation with the maximized lean change. However, when the lean change width is made excessively large, drivability may deteriorate due to the sharp decrease of the fuel injection quantity. Thus, in the present embodiment, for example, as shown in FIG. 7, in the lean spike operation, multiple lean spike segments with the predetermined allowable maximum change width A1 are executed. In other words, the lean spike operation includes multiple spike segments, in each of which the air-fuel ratio is temporarily changed in the lean direction by the predetermined lean change width relative to the reference air-fuel ratio. As a result, while the magnitude of the lean change width is appropriately suppressed, the amount of $O_2$ required for the generation of $H_2$ is still effectively supplied to the catalytic converter 24. In other words, the total oxygen amount to be introduced during the introduction period of the fuel-lean gas for the lean spike operation is divided into multiple spike segments, and the divided amount of the required oxygen is supplied in the execution of each spike segment in the lean spike operation. For example, the lean input time period (lean input time period TB in FIG. 7), during which each spike segment of the lean spike operation is executed, is better to be minimized in order to limit the excessive attachment of oxygen.

Figure 8A:
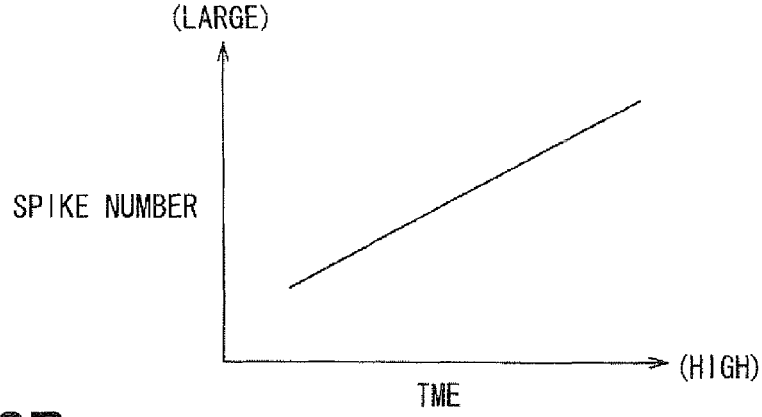
FIG. 8A is a diagram illustrating a relation between an engine coolant temperature the and a spike number.
Figure 8B:
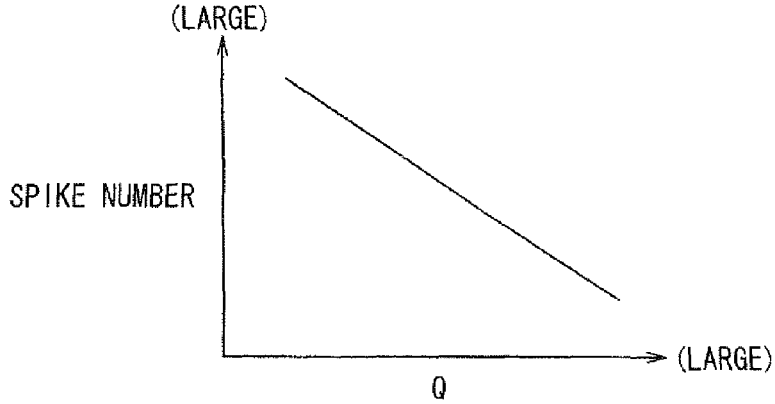
FIG. 8B is a diagram illustrating a relation between an intake air amount and the spike number.

In the present embodiment, the engine coolant temperature and the intake air amount are used as parameters indicative of the engine operational state. The spike number is set based on the above parameters. FIG. 8A is a diagram illustrating a relation between the engine coolant temperature and the spike number. FIG. 8B is a diagram illustrating a relation between the intake air amount and the spike number.

Figure 9:
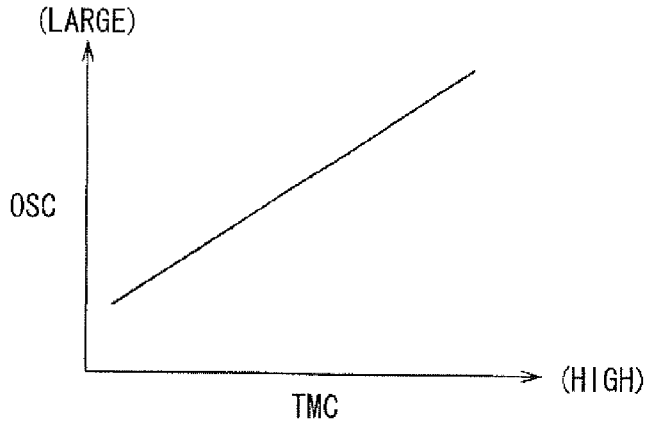
FIG. 9 is a diagram illustrating a relation between a catalytic converter temperature and an oxygen storage amount.

Firstly, the relation between the engine coolant temperature and the spike number will be described. There is correlation between an engine coolant temperature TME and a catalytic converter temperature TMC. Typically, the catalytic converter temperature TMC increases with the increase of the engine coolant temperature TME. Also, there is a correlation between the catalytic converter temperature TMC and an oxygen storage amount OSC stored in the catalytic converter 24. For example, as shown in FIG. 9, the oxygen storage amount OSC increases with the increase of the catalytic converter temperature TMC. In order to maximize the generation amount of $H_2$ through the water-gas shift reaction, the amount of reactants ($CeO_2$ and Pt*—CO) in equation 3 is required to be maximized in a reaction system. Thus, in order to increase $CeO_2$, oxygen is required to be supplied in accordance with the oxygen storage capacity of the catalytic converter 24.

Thus, in the present embodiment, as shown in FIG. 8A, when the engine coolant temperature TME is greater, the spike number is set greater. In other words, the number of the multiple spike segments in the lean spike operation is increased with an increase of temperature of the catalytic converter 24. As a result, when the catalytic converter temperature TMC is higher, or in other words, when the engine coolant temperature TME is higher, the amount of oxygen supplied to the catalytic converter 24 becomes higher. Thereby, the amount of $CeO_2$ in the catalytic converter 24 is increased.

It should be noted that the temperature of the catalytic converter may be directly measured by a temperature sensor, for example. However, the temperature of the catalytic converter may be alternatively estimated based on a parameter (for example, coolant temperature of the internal combustion engine), which correlates with the catalytic converter temperature.

It should be noted that in a case, where there is provided with a temperature sensor that detects the catalytic converter temperature TMC, the spike number may be alternatively determined based on the catalytic converter temperature TMC detected by the sensor.

Also, the oxygen amount introduced to the engine 10 per unit time increases with the increase of an intake air amount Q, and thereby it is expected that blow of the engine 10 may occur. Thus, it is better to shorten the duration for the lean spike operation with the increase of the intake air amount Q. Thus, in the present embodiment, as shown in FIG. 8B, the spike number decreases with the increase of the intake air amount Q.

At step S14 of FIG. 6, timing of executing the lean spike operation or a spike introduction interval is set based on an oxygen storage state (oxygen storage amount) of the three-way catalytic converter 24 after the execution of the lean spike operation. In other words, the lean spike operation is currently executed at a time that is determined based on the oxygen storage state of the catalytic converter 24, which state is determined after the lean spike operation is previously executed. In the present embodiment, the oxygen storage state of the three-way catalytic converter 24 after the execution of the lean spike operation is determined based on the engine operational state. Also, the spike introduction interval is set based on the determination result of the oxygen storage state. Specifically, the engine coolant temperature and the intake air amount are used as parameters indicative of the engine operational state, and the spike introduction interval is set based on the above parameters. Step S14 corresponds to stored oxygen determination means for determining the oxygen storage state of the catalytic converter 24.

Figure 10A:
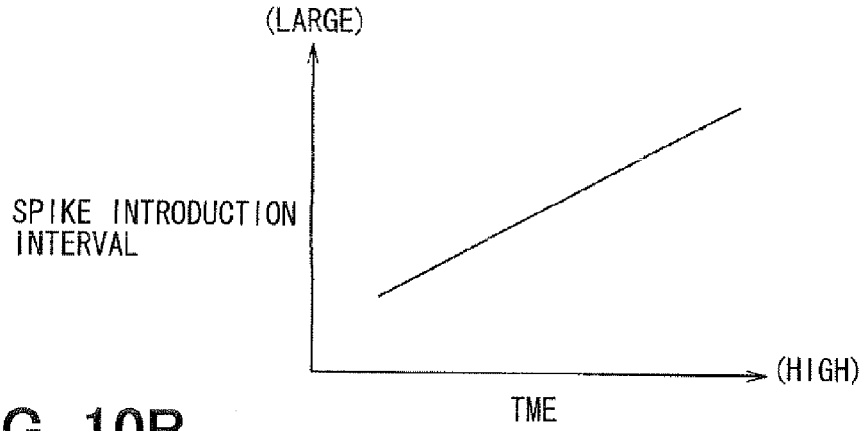
FIG. 10A is a diagram illustrating a relation between the engine coolant temperature and a spike introduction interval.

As above, in order to maximize the generation amount of $H_2$ through the water-gas shift reaction, the amount of the reactant ($CeO_2$ and Pt*—CO) in equation 3 existing in the reaction system needs to be maximized. Therefore, when the catalytic converter temperature TMC is higher and the amount of $CeO_2$ in the catalytic converter 24 is larger, the amount of Pt*—CO is required to be increased accordingly. Thus, in the present embodiment, as shown in FIG. 10A, the spike introduction interval (the time period TS) is set longer with the rise of the engine coolant temperature TME. As a result, when the catalytic converter temperature TMC is higher, or in other words, when the engine coolant temperature TME is higher, a period (the second stage) of supplying CO becomes longer, and thereby the generation amount of Pt*—CO becomes greater.

Figure 10B:
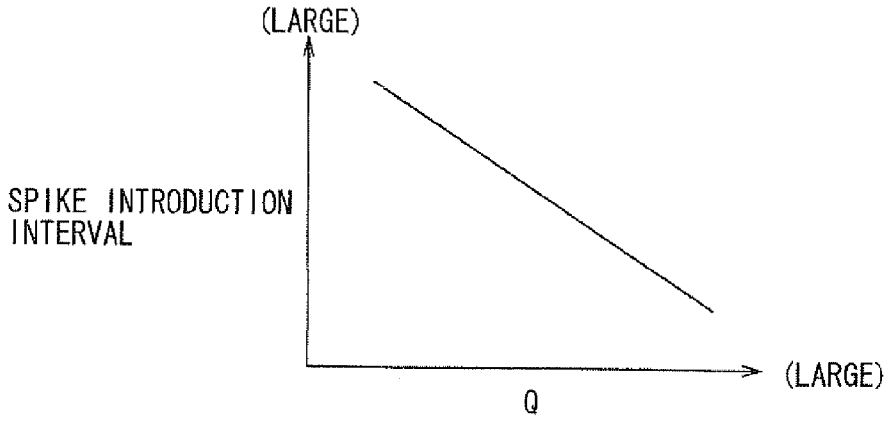
FIG. 10B is a diagram illustrating a relation between an intake air amount and the spike introduction interval.

Also, in the present embodiment, because the spike number decreases with the increase of the intake air amount Q (see FIG. 8B), the amount of $CeO_2$ in the catalytic converter 24 becomes smaller with the increase of the intake air amount Q. As a result, in the relation between the intake air amount and the spike introduction interval, the spike introduction interval is set shorter with the increase of the intake air amount Q as shown in FIG. 10B. Therefore, it is possible to supply an amount of CO that is determined accordingly to the amount of $CeO_2$ in the catalytic converter 24.

At step S15 in FIG. 6, it is determined whether the present time is timing (fuel-lean gas introduction timing) of changing the air-fuel ratio from rich to lean. When it is determined that the present time is the fuel-lean gas introduction timing, control proceeds to step S16, where the lean spike operation is executed. More specifically, the lean spike operation is executed by the multiple spike segments of the spike number set as above. Then, it is determined at step S17 whether an integrated value of the lean input time periods TB becomes equal to or greater than the preset value. In other words, it is determined at step S17 whether the spike number of executing the spike segments becomes the preset number. When it is determined that the spike number has not reached the preset number, control proceeds to step S18, where the fuel-lean gas introduction flag F1 is set as a value 1. Thus, the lean spike operation is repeated until the spike number becomes the preset number. In contrast, when it is determined that the spike number becomes the preset number, corresponding to YES at step S17, control proceeds to step S19, where the fuel-lean gas introduction flag F1 is set at a value 0, and also the air-fuel ratio is switched from lean to slightly rich.

In the present embodiment, advantages described below are achievable.

In the present embodiment, the air-fuel ratio control includes the first stage, in which the lean spike operation is executed, and the second stage, in which the air-fuel ratio after the execution of the lean spike operation is controlled to be slightly rich. As a result, the generation of $CeO_2$ is facilitated in the first stage, and also the generation of Pt*—CO is facilitated in the second stage. Also, because the air-fuel ratio is enriched in the second stage such that the air-fuel ratio stays within the slightly rich region, formation of the coexistence state of Pt*—CO and $CeO_2$ is effectively facilitated. As a result, the generation of $H_2$ through equation 4 is facilitated. Thus, purification of NOx by $H_2$ is facilitated, and thereby NOx purification efficiency is effectively improved.

Because the air-fuel ratio is made slightly rich in the second stage instead of substantially rich, release of oxygen, which has been stored in the catalytic converter 24 through the lean spike operation, to exhaust gas is effectively limited. As a result, it is possible to maximize the period, in which $CeO_2$ and Pt*—CO coexists, and thereby the generation amount of $H_2$ is effectively maximized.

When the engine coolant temperature TME is higher and also when the catalytic converter temperature TMC is higher, the amount of oxygen supplied to the catalytic converter 24 by the lean spike operation is made higher. As a result, the amount of $CeO_2$ in the catalytic converter 24 is effectively increased, and thereby it is possible to facilitate the water-gas shift reaction.

In the present embodiment, because oxygen is supplied by executing the multiple spike segments in the lean spike operation, the deterioration of drivability is effectively limited. Also, because the multiple spike segments with the lean change width that is set at the allowable maximum change width A1 are executed in the lean spike operation, it is possible to effectively limit the deterioration of drivability, and also it is possible to effectively supply the required amount of oxygen for the generation of $CeO_2$ to the catalytic converter 24.

When the engine coolant temperature TME is higher, and also when the catalytic converter temperature TMC is higher, the introduction interval of the lean spike operation is made longer. As a result, it is possible to generate Pt*—CO by an amount that corresponds to the amount of $CeO_2$ in the catalytic converter 24, and thereby it is possible to effectively increase the generation amount of $H_2$ through the water-gas shift reaction.

In the preset embodiment, the first stage, in which the lean spike operation is executed, and the second stage, in which the slightly rich control is executed, constitute one operation cycle, and the operation cycle is repeated. Thus, while Pt*—CO and $CeO_2$ still coexist, the next lean spike operation is executed. As a result, the generation of $H_2$ through the water-gas shift reaction is effectively maintained, and thereby it is possible to effectively continue reducing NOx with the generated $H_2$.

Specifically, in a case, where more oxygen is stored in the catalytic converter 24, the interval for executing the lean spike operation may be relatively elongated. As a result, a period for maintaining the fuel-rich atmosphere is elongated accordingly, and thereby it is possible to supply more CO to the catalytic converter 24. In other words, more precious metal and CO compound, which reacts with the oxygen storage medium ($CeO_2$ in equation 3), is formed when the oxygen storage amount in the catalytic converter 24 is higher. As a result, generation amount of $H_2$ through the water-gas shift reaction is effectively increased.

Because the three-way catalytic converter 24 does not include Rh as the catalyst composition, it is possible to reduce cost. Also, the cost reduction is achievable while the NOx purification efficiency is substantially achieved. Furthermore, without modifying a configuration of a general exhaust gas purification system or without adding a new configuration to the general system, it is possible to achieve the cost reduction and the appropriate NOx purification efficiency.

(Second Embodiment)

Figure 11:
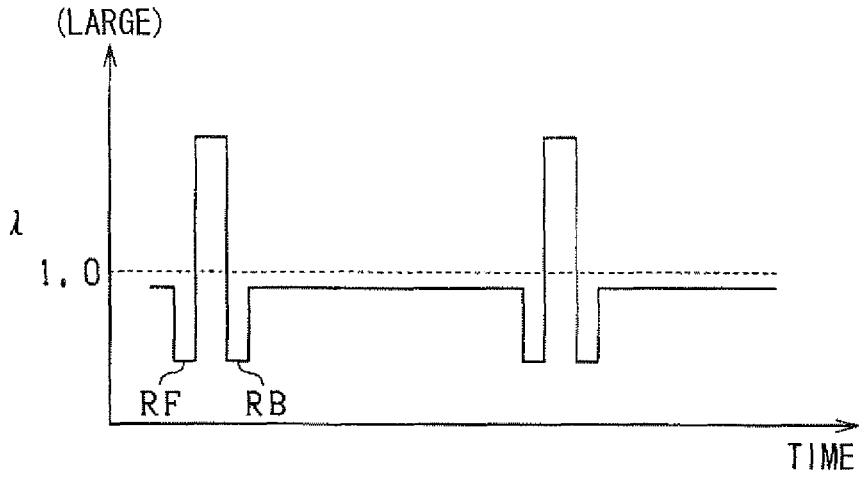
FIG. 11 is a timing chart illustrating an example of the air-fuel ratio control for counter measure of excessive attachment of oxygen.

Next, the second embodiment of the present invention will be described mainly focusing on the difference from the first embodiment. In the present embodiment, as shown in FIG. 11, the air-fuel ratio is controlled at slightly rich, and also the lean spike operation is intermittently executed under the above conditioned slightly fuel-rich atmosphere. In addition to the above, rich inputs (RF, RB), which corresponds to the introduction of fuel-richer gas, are executed immediately before and immediately after the lean spike operation. The rich input RF immediately before the lean spike operation and the rich input RB immediately after the lean spike operation will be described with reference to accompanying drawings.

(Rich Input Immediately Before Lean Spike Operation)

In general, $O_2$ is more likely to adsorb to the precious metal 31 than NOx absorbs to the precious metal 31. In other words, $O_2$ has stronger absorption force to the precious metal 31 than absorption force of NOx. As a result, by the execution of the lean spike operation, $O_2$ in exhaust gas absorbs to the surface of the precious metal 31, and thereby $O_2$ may close or cover catalytic sites of the catalytic converter 24. In other words, by executing the lean spike operation, the excessive attachment of oxygen may occur, and thereby the reduction reaction of the NOx may be limited. Thus, in the execution of the lean spike operation, it is preferable to prepare the counter measure for the excessive attachment. Thereby, the inventors use CO, which has stronger adsorption force to the precious metal 31 than the adsorption force of the $O_2$, as a catalyst protector that protects the catalyst in order to prevent the excessive attachment of oxygen. Specifically, as shown in FIG. 11, during the slightly rich control, the relatively rich input RF (see in FIG. 11) is executed immediately before the lean spike operation. Thus, the rich input RF causes CO to be supplied to the catalytic converter 24 in order to cause CO to adsorb to the surface of the catalytic converter 24. As a result, contact between $O_2$ and the surface of the catalytic converter 24 is effectively limited. The relatively rich input RF means the introducing of the fuel-rich gas that has an air-fuel ratio richer than an air-fuel ratio of the predetermined slightly rich region.

Figure 12A:
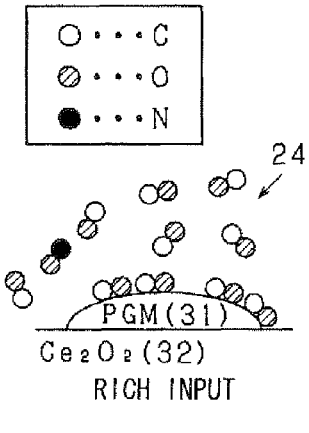
FIG. 12A is a schematic diagram for explaining the counter measure of the excessive attachment.
Figure 12B:
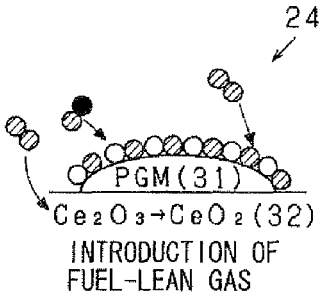
FIG. 12B is another schematic diagram for explaining the counter measure of the excessive attachment.
Figure 12C:
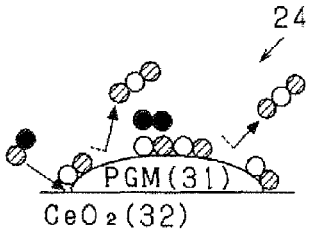
FIG. 12C is still another schematic diagram for explaining the counter measure of the excessive attachment.

The above mechanism will be described with reference to schematic diagrams of FIG. 12A to FIG. 12C. Indicators of C, O, and N in FIG. 12A are applicable to FIGS. 12B and 12C. FIG. 12A shows a case, where the air-fuel ratio is shifted to be relatively rich during the slightly rich control. In the above case, CO in exhaust gas is increased such that a large amount of CO is supplied to the catalytic converter 24, and thereby supplied CO adsorbs to the surface of the catalytic converter 24 (the surface of the precious metal 31).

When the air-fuel ratio is switched to be lean under the above condition, the amount of $O_2$ in exhaust gas is increased, and thereby $Ce_2O_3$ serving as the co-catalyst 32 changes to $CeO_2$. In other words, when the air-fuel ratio is switched to be lean, $O_2$ is stored. In the above, although the large amount of $O_2$ is supplied to the catalytic converter 24, the excessive attachment of oxygen to the catalytic converter 24 is effectively limited because the surface of the precious metal 31 is covered or protected by CO as shown in FIG. 12B. Also, as shown in FIG. 12C, CO on the surface of the catalytic converter 24 is converted into $CO_2$ after reaction with $O_2$ and with NOx in exhaust gas under the fuel-lean atmosphere, and then $CO_2$ is released.

(Rich Input Immediately after Lean Spike Operation)

Even if the counter measure for the excessive attachment of $O_2$ is prepared before the lean spike operation, the excessive attachment may be caused by the execution of the lean spike operation. Thus, recovery measure to recover from the excessive attachment of oxygen is executed for the possible excessive attachment. In the present embodiment, the relatively rich input RB is executed immediately after the lean spike operation as shown in FIG. 11, and the rich input RB causes CO to be supplied to the catalytic converter 24. Thus, CO is excessively supplied as compared to the normal slightly-rich condition, and thereby the supplied CO reacts with $O_2$, which adsorbs or attaches to the surface of the catalytic converter 24, to form $CO_2$. As above, $O_2$ is released from the surface of the catalytic converter 24. The relatively rich input RB means the introducing of the fuel-rich gas that has an air-fuel ratio richer than an air-fuel ratio of the predetermined slightly rich region.

Figure 13A:
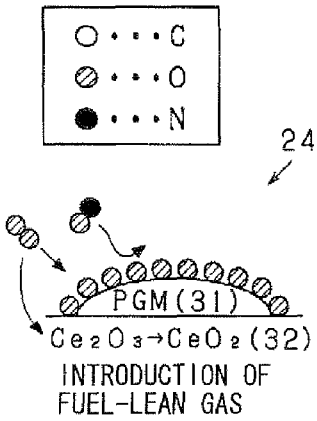
FIG. 13A is a schematic diagram for explaining the counter measure of the excessive attachment.
Figure 13B:
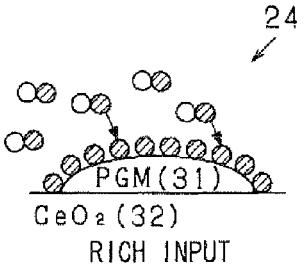
FIG. 13B is another schematic diagram for explaining the counter measure of the excessive attachment.
Figure 13C:
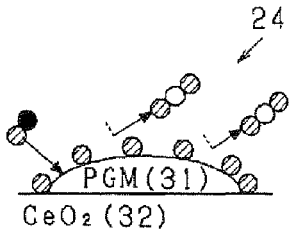
FIG. 13C is still another schematic diagram for explaining the counter measure of the excessive attachment.

The mechanism will be described with reference to schematic diagrams in FIG. 13A to FIG. 130. Indicators of C, O, and N in FIG. 13A are applicable to FIGS. 13B and 13C. FIG. 13A shows a condition, where excessive attachment of $O_2$ occurs due to the introduction of fuel-lean gas. In the above, when the air-fuel ratio is switched to be relatively rich, CO in exhaust gas in increased, and thereby a large amount of CO is supplied to the catalytic converter 24. Thus, the supplied CO reacts with $O_2$ on the catalytic converter surface (see FIG. 13B). As a result, as shown in FIG. 13C, $O_2$, which absorbs or attaches to the catalytic converter surface, forms $CO_2$, and then is released from the catalytic converter 24. Thus, the excessive attachment of oxygen is removed effectively.

Figure 14:
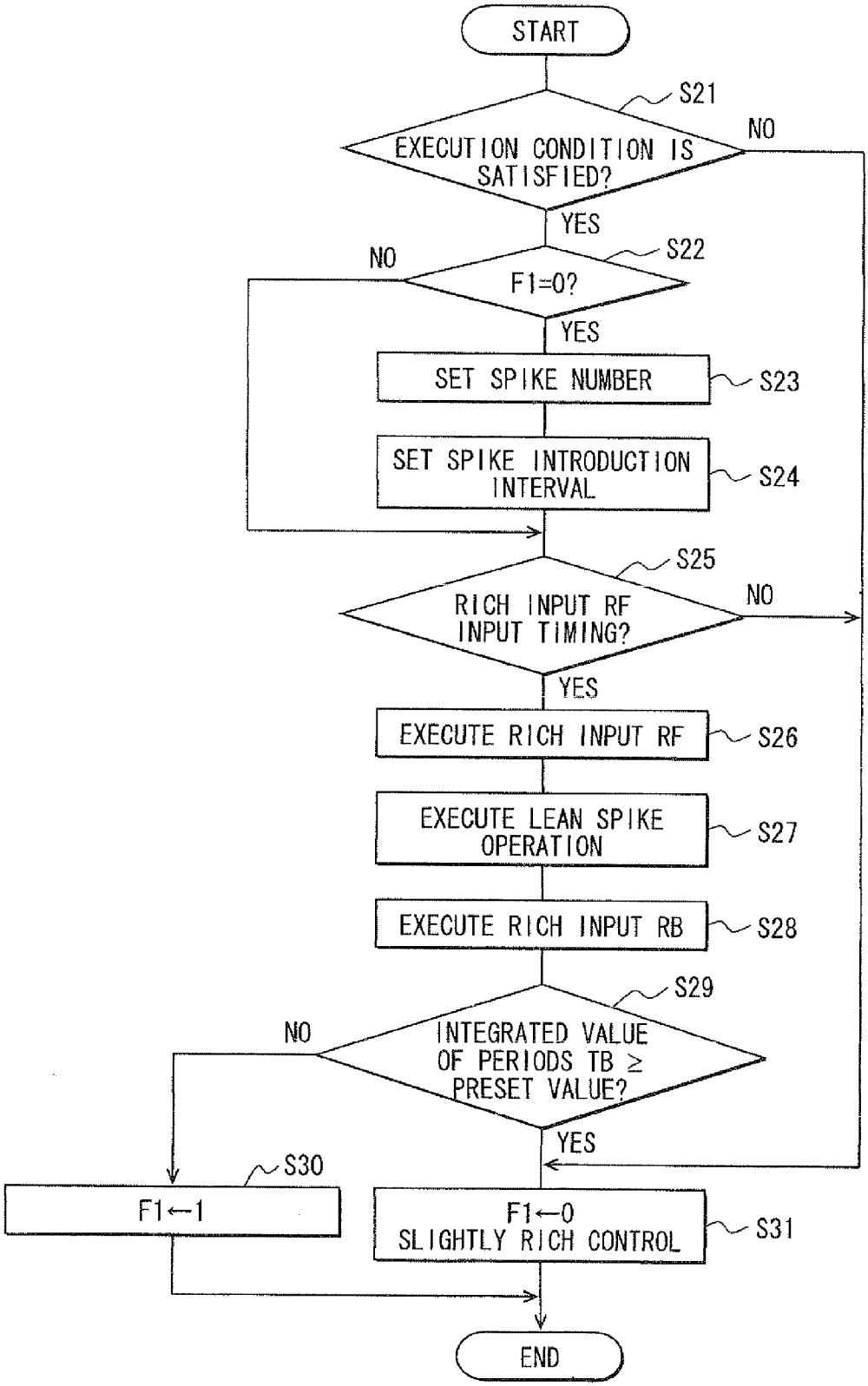
FIG. 14 is a flow chart illustrating procedure of air-fuel ratio control according to the second embodiment of the present embodiment.

Next, procedure of an exhaust gas purification process of the present embodiment will be described. FIG. 14 is a flow chart illustrating procedure for facilitating the water-gas shift reaction. This process is executed by the microcomputer 41 of the ECU 40 at predetermined intervals. It should be noted that in the description below, the steps in FIG. 14 similar to the steps in FIG. 6 will be designated by the counterparts in FIG. 6, and the explanation thereof will be omitted.

At steps S21 to S24 in FIG. 14, process similar to process at steps S11 to S14 in FIG. 6 is executed. Then, it is determined at step S25 whether the present time is timing of inputting the rich input RF (or whether the rich input RF is required to be executed). When it is determined that the present time is timing of inputting the rich input RE, control proceeds to step S26, where the rich input RE is executed. The rich input RF serves as the counter measure for the excessive attachment and prevents the excessive attachment of oxygen. Means for introducing the fuel-rich gas immediately before the lean spike operation corresponds to step S25.

Subsequently, at step S27, a single spike segment in the lean spike operation is executed. In other words, a single spike segment among the multiple spike segments of the above-set spike number in the lean spike operation is executed. Then, control proceeds to step 28, where the rich input RB is executed. The rich input RB serves as the counter measure for the excessive attachment, and contributes the recovery from the excessive attachment of oxygen. Means for introducing the fuel-rich gas immediately after the lean spike operation corresponds to step S28.

It should be noted that the input time period for the rich inputs RE, RB is, for example, set based on the engine operational state (intake air amount). Also, in order to effectively store $O_2$ during the period under the fuel-lean atmosphere, it is preferable to make the input time period shorter than the period, during which the single spike segment of the lean spike operation is executed. A rich change width, which corresponds to a magnitude for changing the air-fuel ratio in the rich direction, may be set within an allowable range that does not harm the drivability as required. For example, in order to more effectively store $O_2$ during the period under the fuel-lean atmosphere, the rich change width is made smaller than the lean change width.

At step S29, it is determined whether an integrated value of the lean input time periods TB becomes equal to or greater than a preset value. In other words, it is determined at step S29 whether the spike number becomes the preset number. When the spike number has not reached the preset number, control proceeds to step S30, where the fuel-lean gas introduction flag F1 is set as the value 1. As a result, the rich input RF, the lean spike operation, and the rich input RB are repeatedly executed in this order until the spike number becomes the preset number, in other words, in the present embodiment, for every execution of the lean spike operation, the rich input is executed before and after the execution of the lean spike operation. Then, when the spike number becomes the preset number, the fuel-lean gas introduction flag F1 is set as the value 0 at step S31, and the air-fuel ratio is switched from lean to slightly rich.

Figure 15:
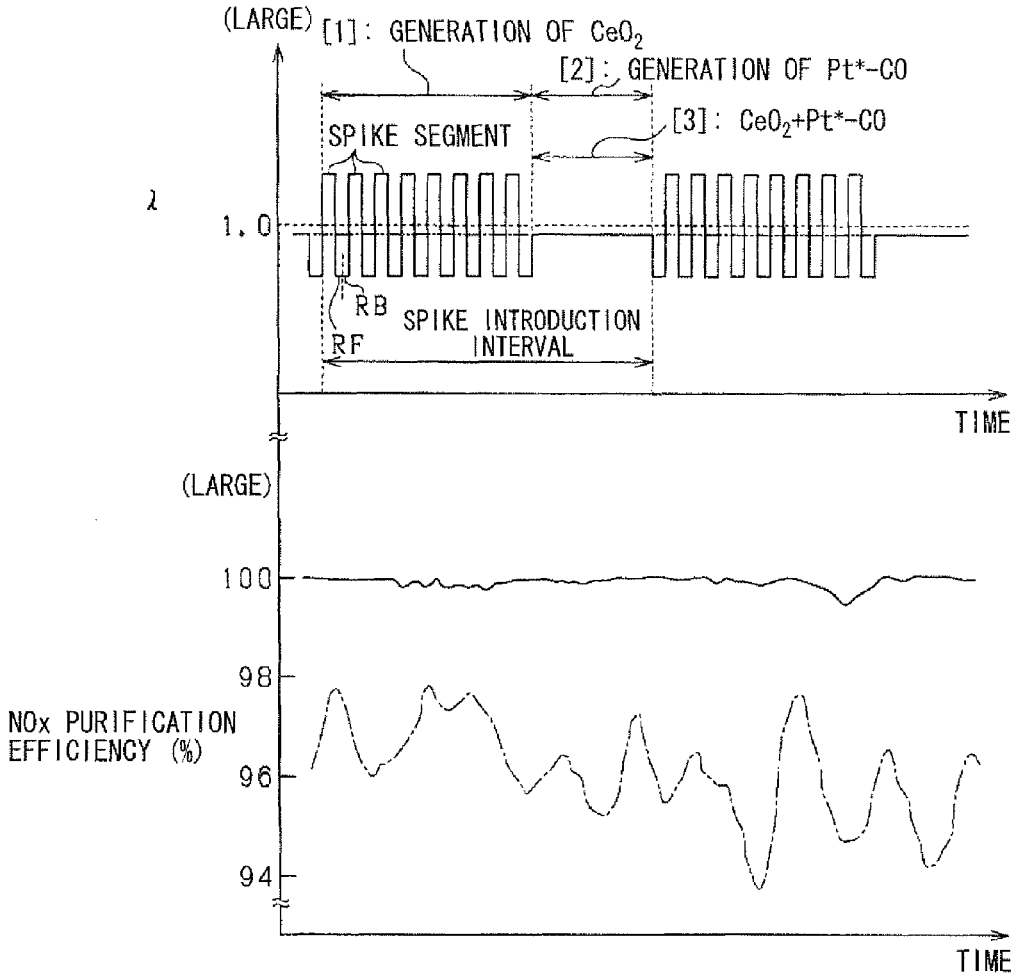
FIG. 15 is a timing chart illustrating an example of air-fuel ratio control according to the second embodiment.

FIG. 15 is a timing chart illustrating a trend of the air-fuel ratio and the NOx purification efficiency in the air-fuel ratio control of the present embodiment. It should be noted that in FIG. 15, a solid line illustrates a case, where the lean spike operation is executed during the slightly rich control coupled with the execution of the rich inputs RF, RB before and after the lean spike operation as described above in the present embodiment. Also, a dashed and single-dotted line illustrates the comparison case, where both the lean spike operation and the rich input are not executed during the slightly rich control.

As shown in FIG. 15, in the air-fuel ratio control, for a case indicated by the solid line, where the lean spike operation and the rich input are executed, a NOx purification efficiency is stabilized around 100%. Also, the degradation of the NOx purification efficiency caused by the lean spike operation is hardly observed. In contrast, for the comparison case indicated by the dashed and single-dotted line, where the lean spike operation and the rich input are not executed, the NOx purification efficiency degrades and is unstable as compared to the present embodiment. Thus, by executing the air-fuel ratio control of the present embodiment, where the lean spike operation is executed during the slightly rich control coupled with the execution of the rich input before and after the lean spike operation, it is possible to purify exhaust gas more efficiently than the comparison case.

The present embodiment achieves advantages shown below.

In the present embodiment, the lean spike operation is executed during the slightly rich control, and the relatively rich input RF is executed immediately before the introduction of the lean spike operation. As a result, the three-way catalytic converter 24 is caused to be temporarily exposed to the fuel-rich atmosphere before the lean spike operation. Thus, CO in exhaust gas adsorbs to the surface of the catalytic converter 24, and thereby the catalytic sites of the catalytic converter 24 is covered or protected by CO from $O_2$. As a result, the formation of $H_2$ through the subsequent water-gas shift reaction is not inhibited, and thereby the purification of NOx is effectively executed.

In the present embodiment, the relatively fuel-rich gas is temporarily introduced immediately after the execution of the lean spike operation, and then the air-fuel ratio is shifted to be slightly rich. Thus, it is possible to temporarily expose the three-way catalytic converter 24 to the relatively fuel-rich atmosphere after the execution of the lean spike operation. As a result, $O_2$, which has adsorbed to the surface of the catalytic converter 24, reacts with CO in fuel-rich gas to form $CO_2$. Thus, it is possible to effectively release the oxygen that has adsorbed to the surface of the catalytic converter 24, and thereby it is possible to remove the excessive attachment of oxygen at an earlier stage.

In the present embodiment, the rich inputs RF, RB are executed immediately before and immediately after each spike segment in the lean spike operation. As a result, it is possible to effectively deal with the excessive attachment of oxygen, and thereby it is possible to maintain the NOx purification efficiency at a high ratio.

(Other Embodiment)

The present invention is not limited to the above embodiments. For example, the present invention may be modified as below.

The oxygen storage state of the three-way catalytic converter 24 after the execution of the lean spike operation (oxygen storage amount) is determined based on the catalytic converter temperature TMC and the intake air amount Q, and the lean spike operation is executed at timing determined based on the catalytic converter temperature TMC and the intake air amount Q. However, a parameter used in the determination of the oxygen storage state is not limited to the above. For example, a NOx sensor may alternatively be provided downstream of the three-way catalytic converter 24, and the lean spike operation may be executed at timing determined based on an output value of the sensor. Specifically, the NOx purification efficiency after the execution of the lean spike operation may be monitored based on the output value of the NOx sensor. When the decrease of the NOx purification efficiency is detected (for example, when the NOx purification efficiency becomes equal to or less than a predetermined value), another lean spike operation is executed.

Alternatively, the amount of $CeO_2$ in the catalytic converter 24 (oxygen residual amount) may be monitored based on the electromotive force value of the $O_2$ sensor 34. When the oxygen residual amount becomes equal to or less than a predetermined value, another lean spike operation is executed. Specifically, in FIG. 3B, when the $O_2$ sensor output becomes constant, or when a predetermined time has elapsed since the $O_2$ sensor output becomes constant (for example, at timing t12), or when the $O_2$ sensor output becomes equal to or greater than a predetermined value, another lean spike operation is executed. Due to the above, while Pt*—CO and $CeO_2$ coexist, the next lean spike operation is executed, and as a result, the formation of $H_2$ through the water-gas shift reaction is effectively continued. Also, on the contrary, it may be estimated that the oxygen residual amount becomes equal to or less than the predetermined value when the predetermined interval elapses after the preceding execution of the lean spike operation. Thus, the lean spike operation may be executed at the predetermined intervals.

It should be noted that the residual amount of $CeO_2$ in the catalytic converter 24 may be measured based on, for example, the NOx purification efficiency, the output value from the oxygen sensor located downstream of the catalytic converter 24, or an elapsed time from the timing of executing the previous lean spike operation.

In the above embodiments, the first stage, in which the lean spike operation is executed, and the second stage, in which the air-fuel ratio is kept slightly rich, constitute one cycle having the time period TS, and the one cycle is repeated one after another. However, the above one cycle of the time period TS may be alternatively executed once at predetermined intervals.

In the second embodiment, as the counter measure for the excessive attachment of oxygen, the rich inputs are executed immediately before and immediately after the lean spike operation. Alternatively, the rich input may be executed only immediately before or immediately after the lean spike operation. In the above alternative case, the rich input RF immediately before the lean spike operation is preferably executed to the rich input RB immediately after the lean spike operation.

In a case, where the multiple spike segments are executed in the lean spike operation, the fuel-rich gas may be introduced immediately before any one of the spike segments in the lean spike operation. In order to improve the NOx purification efficiency by limiting the excessive attachment of oxygen, the fuel-rich gas may be introduced immediately before all of the spike segments in the lean spike operation.

In the above embodiments, the rich inputs are executed before and after each spike segment of the lean spike operation. Alternatively, the rich input may be executed immediately before or immediately after only a part of the spike segments of the lean spike operation. For example, the rich inputs may be alternatively executed immediately before the first spike segment of the lean spike operation and immediately after the last spike segment of the lean spike operation. Alternatively, the rich input may be executed immediately before and immediately after every other spike segment of the lean spike operation. Also, the rich input may be executed immediately before and immediately after every three or more spike segments of the lean spike operation.

In the above embodiments, Pt is used as the catalyst composition (the precious metal 31) of the three-way catalytic converter 24. However, Pd or Rh may be alternatively used. Also, two or more of Pt, Pd, and Rh may be used together as the catalyst composition, The above embodiment describes a configuration having the three-way catalytic converter 24. However, any catalytic converter, which includes an oxygen storage medium and the precious metal 31, may be used instead of the three-way catalytic converter 24.

Additional advantages and modifications will readily occur to those skilled in the art. The invention in its broader terms is therefore not limited to the specific details, representative apparatus, and illustrative examples shown and described.

What is claimed is:

1. An exhaust gas purifying apparatus for an internal combustion engine, wherein an exhaust passage of the internal combustion engine is provided with a catalytic converter that includes an oxygen storage medium and a precious metal, wherein the oxygen storage medium stores and releases oxygen in exhaust gas, wherein the precious metal serves as a catalyst composition, the exhaust gas purifying apparatus comprising:

lean control means for executing a lean spike operation, in which an air-fuel ratio is temporarily changed in a lean direction by a lean change width relative to a reference air-fuel ratio;

rich control means for executing a rich control in which the air-fuel ratio is changed in a rich direction by a rich change width relative to the reference air-fuel ratio such that the air-fuel ratio stays in a predetermined slightly rich region, the rich change width being smaller than the lean change width; and stored oxygen determination means for determining an oxygen storage state of the catalytic converter after the lean control means previously executes the lean spike operation, wherein:

the lean control means executes the lean spike operation in order to cause the oxygen storage medium to store oxygen, the lean control means executes the lean spike operation for an introduction period of a fuel-lean gas during a spike introduction interval, the lean spike operation includes one or more spike segments in the introduction period of the fuel-lean gas, in each of spike segments, the air-fuel ratio is temporarily changed in the lean direction by the lean change width relative to the reference air-fuel ratio, the rich control means executes the rich control after the lean spike operation during the spike introduction interval, such that the spike introduction interval includes a single lean spike operation and a single rich control, the spike introduction interval is determined based on the oxygen storage state of the catalytic converter and the temperature of the catalytic converter, and is increased with an increase in temperature of the catalytic converter, the rich control means controls the air-fuel ratio to stay in the predetermined slightly rich region in order to cause a specified component in exhaust gas to adsorb to a surface of the precious metal, and also in order to limit the oxygen storage medium from releasing oxygen stored therein, the reference air-fuel ratio is a theoretical air-fuel ratio, and the predetermined slightly rich region is a predetermined range near the theoretical air-fuel ratio.

2. The exhaust gas purifying apparatus according to claim 1, wherein:

the lean spike operation includes a plurality of spike segments, in each of which the air-fuel ratio is temporarily changed in the lean direction by the lean change width relative to the reference air-fuel ratio.

3. The exhaust gas purifying apparatus according to claim 2, wherein:

the lean control means increases a number of the plurality of spike segments with an increase of temperature of the catalytic converter.

4. The exhaust gas purifying apparatus according to claim 1, further comprising:

means for introducing fuel-rich gas immediately before the lean spike operation; and the fuel-rich gas has an air-fuel ratio that is richer than an air-fuel ratio of the predetermined slightly rich region.

5. The exhaust gas purifying apparatus according to claim 1, further comprising:

means for introducing fuel-rich gas immediately after the lean spike operation; and the fuel-rich gas has an air-fuel ratio that is richer than an air-fuel ratio of the predetermined slightly rich region.

* * * * *